US007918505B2

(12) United States Patent
Raphael et al.

(10) Patent No.: US 7,918,505 B2
(45) Date of Patent: Apr. 5, 2011

(54) ROCKING DEVICE

(76) Inventors: Alison Ruth Raphael, Radlett (GB); Sophie Miriam King, Hertforshire (GB)

( * ) Notice: Subject to any disclaimer, the term of this patent is extended or adjusted under 35 U.S.C. 154(b) by 131 days.

(21) Appl. No.: 12/304,842

(22) PCT Filed: Jun. 15, 2006

(86) PCT No.: PCT/GB2006/002182

§ 371 (c)(1),
(2), (4) Date: Jan. 13, 2009

(87) PCT Pub. No.: WO2007/144548

PCT Pub. Date: Dec. 21, 2007

(65) Prior Publication Data

US 2009/0206642 A1 Aug. 20, 2009

(51) Int. Cl.
*A47C 3/02* (2006.01)
*A47C 3/027* (2006.01)

(52) U.S. Cl. ..... 297/260.2; 297/263.1

(58) Field of Classification Search ..... 297/258.1, 297/260.2, 261.2, 261.1, 261.3, 263.1, 263.2, 297/344.21, 344.23; 5/109; 472/29; 248/415
See application file for complete search history.

(56) References Cited

U.S. PATENT DOCUMENTS 3,191,594 A 6/1965 Bagnell
5,660,430 A * 8/1997 Clarke ..... 297/130

FOREIGN PATENT DOCUMENTS

GB 2241433 A 9/1991
GB 2421175 A 6/2006
WO WO03079861 A1 10/2003

OTHER PUBLICATIONS

Written opinion of the ISR for International Application PCT/GB2006/002182.

* cited by examiner

*Primary Examiner* — Milton Nelson, Jr.
(74) *Attorney, Agent, or Firm* — Hancock Hughey LLP

(57) ABSTRACT

A rocking device with a seat unit such as a chair, crib or cot, or attachment mechanisms for same with a motion generator comprising a profiled track defining a closed undulating path and a track follower, to interact with the track whilst one or other is rotated, thereby creating relative displacement between the seat unit and a base unit to simulate the motion of a vehicle. The device has mechanisms to decouple the relative displacement between the seat and the base from any rotational movement of the chair. The device is particularly effective at inducing sleep and restfulness in children. The invention also includes profiled tracks, and method for producing them from recording motion experienced by passengers in moving vehicles.

9 Claims, 4 Drawing Sheets

ROCKING DEVICE

FIELD OF THE INVENTION

The invention relates to devices to rock an individual to provide comfort, and particularly to devices to soothe a child and induce sleep.

PRIOR ART KNOWN TO THE APPLICANT

It is well known that the gentle rocking or moving of a child will have the effect of soothing it, often to the extent of inducing sleep. Parents often rock children in prams and pushchairs to provide this calming effect. Since the age of the motor vehicle, parents have also discovered that the gentle motion experienced by a child travelling in a car often has a similar effect. Despite the many and self-evident drawbacks, many parents desperate to get their child asleep have resorted to driving around with the child in the car just induce this soothing and sleep-inducing effect.

Over the years, many devices have been developed to automate the process of inducing relaxation or sleep in infants.

U.S. Pat. No. 5,711,045 describes apparatus for inducing relaxation or sleep in infants comprising, in essence, a child seat mounted on three elliptical cams that rotate and cause the seat to move.

UK Patent Application GB 2355923 describes an oscillating infant seat assembly for an infant "bouncer" seat of the type having a resilient frame and base located directly below a seat. The device is provided with a crank arm to impart vertical reciprocal motion to the base of the seat, the frequency of which can be adjusted to match the natural frequency of the seat for a particular weight of baby.

International Patent Application WO 02/05687 describes in general terms, a seat mounted on a multi-dimensional actuator where the actuator is capable of generating a motion that simulates the motion of a moving vehicle. The device is said to promote sleeping in a seated user.

UK Patent Application GB 2307025 describes yet another rocking baby seat device in which a baby seat device in which a baby seat is held in a main base unit housing a moving generator. The movement generator comprises an oscillating crank to rock the seat back and forth. The device is said to mimic the movements of a vehicle in motion, and thereby induce sleep in a baby using the device.

International Patent Application WO 2004/107927 describes a cradle mounted on a chassis with springs and electromagnets, and is said to reproduce the rocking and acoustic environment experienced by an infant in a basket strapped in a moving car.

Also known to the applicant is international patent application WO 99/10062. This is, in fact an infant entertainment device, designed to entertain, and therefore maintain an infant in a state of arousal through play. The device has a seat member and an undulating track, connected to the seat by a rod. The seat is rotated by a motor, and the interaction of the rod and track cause the seat to rock as the seat rotates.

All these devices have various shortcomings, including the provision of only simple reciprocating motion, that fails to mimic that experienced by a child in a car or the use of highly complex actuators and control systems to attempt to mimic such motion leading to devices that are unwieldy and complex with associated likelihood of mechanical failure and high manufacturing costs. Furthermore, as configured, the devices are only capable of reproducing a single pattern of movement without extensive reprogramming or adjustment of cam wheels and the like. In the entertainment device, not only is the motion of the chair is constrained about a single axis by the hinged connection (thus only allowing rocking, and not pitching), but the chair needs to rotate as well, in order to produce the movement.

It is an object of the present invention to attempt a solution to at least some of these, and other problems.

SUMMARY OF THE INVENTION

Accordingly, the invention provides, in a first aspect, a rocking device comprising a seat unit (as defined herein) and a base unit, operatively coupled by a motion generator, said motion generator comprising: a profiled track defining a closed undulating path; a track follower, arranged to interact with said profiled track; and means to impart relative rotational movement between said profiled track and said track follower, thereby creating relative displacement between said seat unit and said base unit, characterized by the provision of decoupling means to decouple the relative displacement between the seat and base from any rotational movement of the chair.

In a second aspect, the decoupling means comprises a rotatable mounting between at least one of said seat unit and base unit and at least one of said profiled track and track follower.

In a third aspect, the rocking device further comprises a damper to modulate the relative displacement between the seat unit and the base unit.

Preferably, the rocking device of aspect 3 comprising a plurality of dampers.

Preferably also, in the rocking device of either aspect 3 or aspect 4 a damper is operably connected between the seat unit and the base unit.

Preferably also, in the rocking device of either aspect 3 or aspect 4 a damper is operably connected between the seat unit and the track follower.

In any aspect of the invention it is preferable that the profiled track is so shaped as to create relative displacement between the seat unit and the base unit in more than one spatial dimension.

Also included within the scope of the invention is a profiled track adapted for use with a rocking device as described above.

Also included within the scope of the invention is a method of making a profiled track for use with a rocking device, comprising the steps of: measuring the displacement of an object within a travelling vehicle; using those measurements to shape a track so as to mimic the displacement of the object so measured.

The movement experienced by a child in a travelling car may be measured using motion detectors such as accelerometers attached to a child seat in a car. The range of motion is measured and recorded during a typical journey, and transcribed onto a profiled track by e.g. machining or moulding. The mechanism of recording and playback is analogous to that used in the production and playing of vinyl records, where the pattern on the record is converted to sound by the needle, or stylus, responding to the pattern on the disc. Where the profiled track reproduces movement in multiple spatial dimensions, the process in analogous to a stereo vinyl record, where one track is reproduced by up-and-down movement of the stylus, and the other track by a side-to-side movement.

Also included within the scope of the invention is a rocking device substantially as described herein, with reference to, and as illustrated by, any appropriate combination of the accompanying drawings.

In the invention as defined above, the "seat unit" may comprise a seat, crib or cot, with or without a support plate, or merely a support plate adapted to receive a seat, crib or cot. In this way, a seat such as a specially adapted car seat, or a carrycot may be attached to the unit. As a child will be used to the seat in which they travel by car, this more closely mimics the "driving experience" that is known to induce restfulness and sleep. An additional feature in any of these devices is also the provision of mounting points on the base unit, to allow the whole unit to replace a conventional car seat. In this way, once a car journey is complete, the unit can be activated to mimic further travel, thus prolonging the sleep-inducing effect whilst the car is stationary. Parents would find this particularly useful in situations such as camping or caravanning, where, upon arrival at their destination, they would like a child to remain asleep whilst they erected a tent, or secured the caravan pitch.

BRIEF DESCRIPTION OF THE DRAWINGS

The invention will be described with reference to the accompanying drawings, in which.

DESCRIPTION OF PREFERRED EMBODIMENTS

Figure 1:
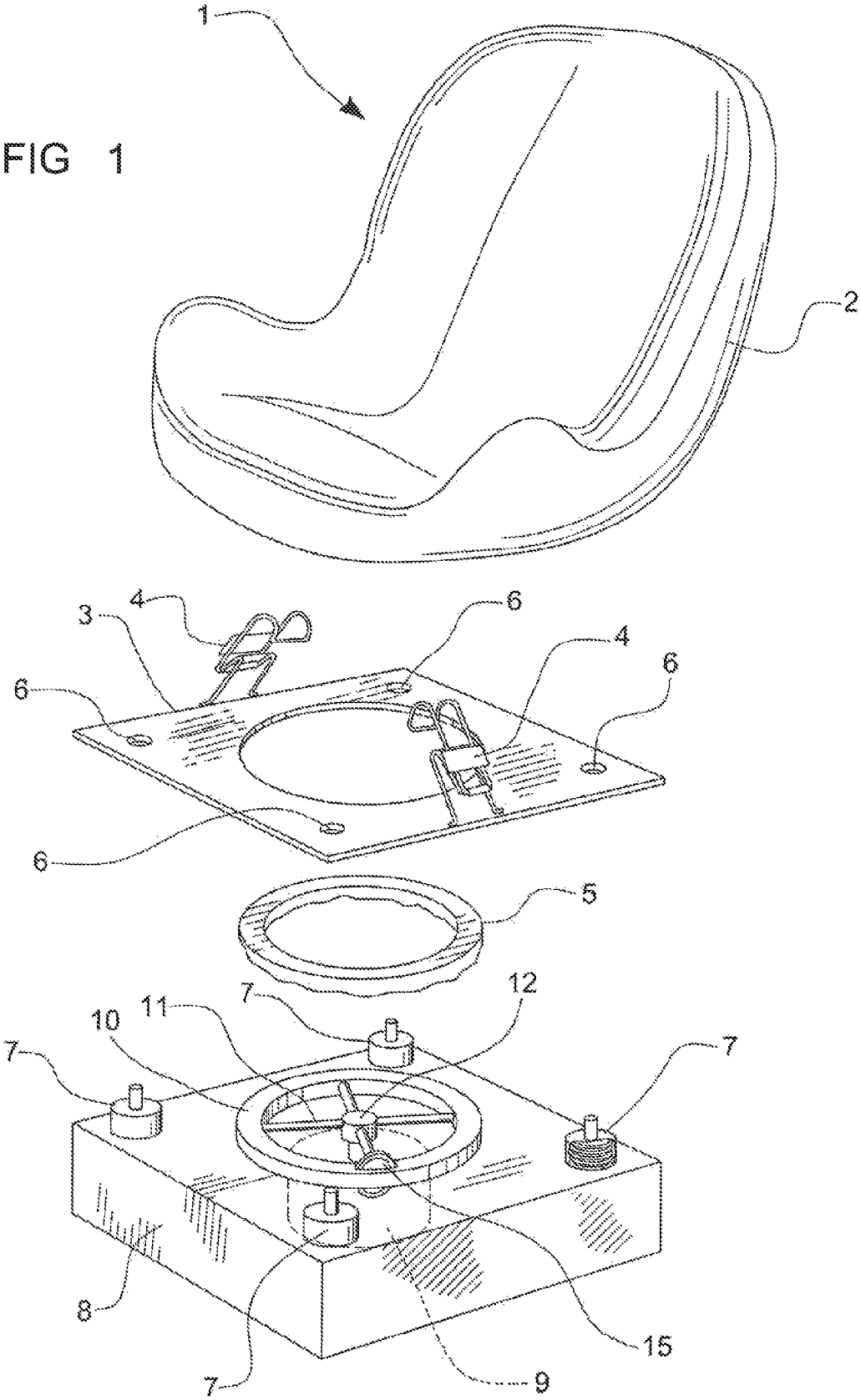
FIG. 1 is an exploded view of an embodiment of the invention.
Figure 2A:
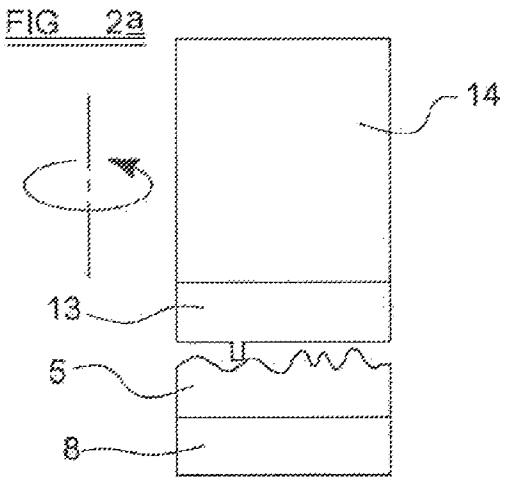
FIG. 2 shows schematic views of the prior art (FIG. 2*a*) and various embodiments of the present invention (FIGS. 2*b*-2*e*)
Figure 2B:
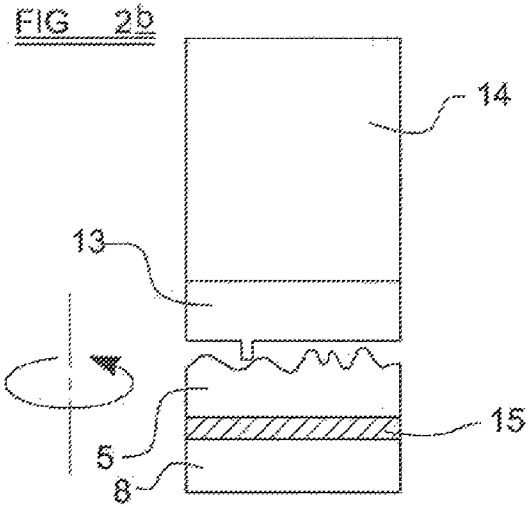
Figure 2C:
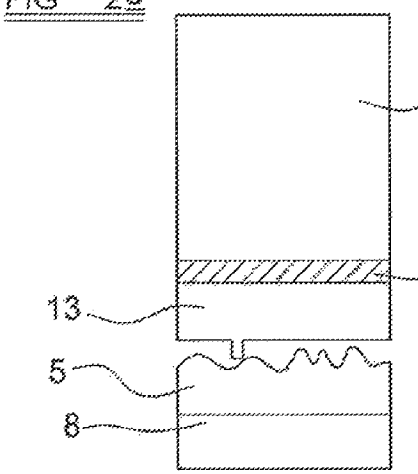
Figure 2D:
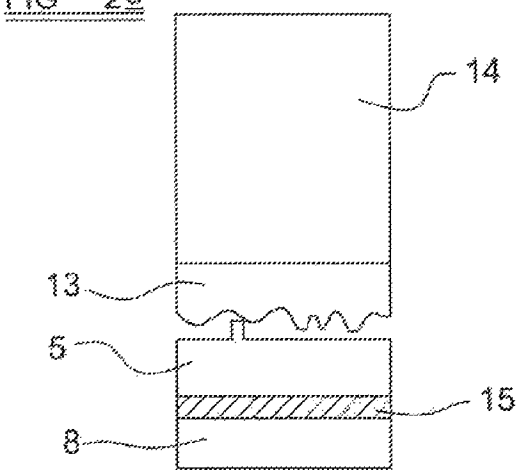
Figure 2E:
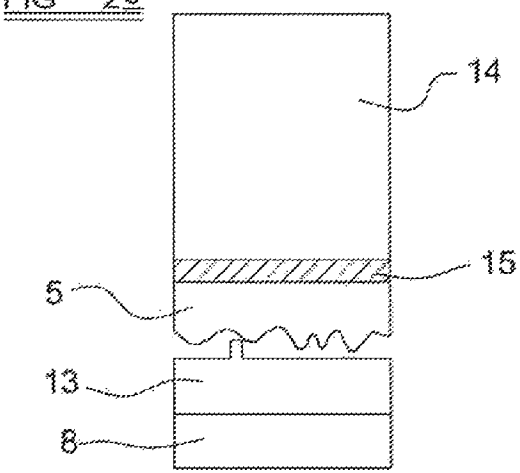

FIG. 1 shows an exploded view of a rocking device, generally indicted by 1, according to the present invention. The device 1 comprises a chair, or seat, 2, attachable to a support plate 3 by means of clips 4. Affixed to the underside of the support plate 3 is a profiled track 5 defining a closed undulating path, facing downwards. The support plate 3 has four holes 6 that engage, slideably, with spring damper units 7, located on a base unit 8. Located within the base unit 8 is a motor 9 that drives a horizontally oriented wheel 10, connected to the motor 9 via spokes 11 and a central hub 12. Located towards the periphery of the wheel 10 is a track follower 13, in this embodiment in the form of a rotatable wheel.

As the horizontal wheel 10 rotates, the track follower 13 engages with the undulating profiled track 5, and causes the seat 2 to move in response to the profile of the track. The rotating wheel 10 and motor assembly 9 thereby creates a relative displacement between the seat unit and the base unit, whilst decoupling the relative displacement from any rotational movement of the chair.

FIG. 2(*a*) illustrates, schematically, the operation of the child entertainment device described in WO 99/10062. A seat unit, 14 is attached to a track follower 13 that interacts with an undulating track 5 attached to a base unit 8. As the seat is rotated (as indicated) the track follower 13 interacts with the undulating track 5 and causes the seat to rock (about a single axis) as the seat rotates—the rocking and rotation are coupled together.

FIGS. 2(*b*) to 2(*e*) illustrate, again schematically, embodiments of the present invention. All these embodiments have a seat unit 14, a track follower 13, an undulating track 5 and a base unit 8. The devices also have means—such as a motor—to rotate the undulating track 5 with respect to the track follower 13; this is not illustrated in FIG. 2, for sake of clarity.

In addition, the devices have means 15 to decouple the relative displacement between the seat and base from any rotational movement of the chair 14. The various embodiments show possible arrangements of the elements with the track follower 13 being mounted to the seat unit 14 (FIGS. 2*b* and 2*c*) or to the base unit 8 (FIGS. 2*d* and 2*e*), and the decoupling means 15 being mounted variously between the track 5 and the base 8 (FIG. 2*b*); the track follower 13 and the seat 14 (FIG. 2*c*); the track follower 13 and the base 8 (FIG. 2*d*); or the track 5 and the seat 14. Many appropriate decoupling means will be apparent to the skilled addressee, such as contacting slideable plates or rotatable mountings. In the embodiment of FIG. 1, the decoupling is provided by the motor itself rotating the track follower relative to the base unit.

Figure 3:
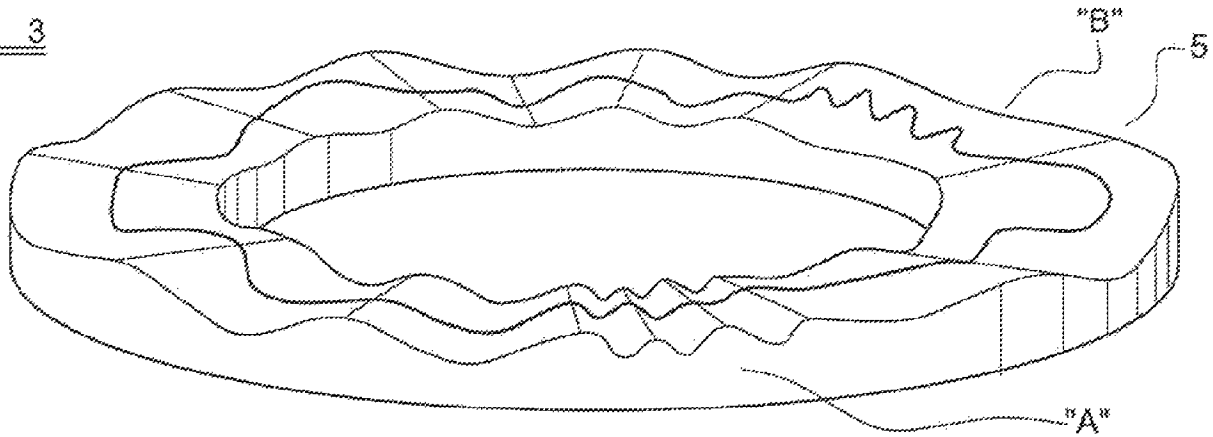
FIG. 3 is a perspective view of a profiled track.

FIG. 3 illustrates a profiled track 5 according to the present invention. The track defines a closed undulating path on its upper (as illustrated) surface. It can be seen that the undulations in the track define a path that varies in both its frequency of undulation and in its amplitude. The section of track around position "A" defines a region of high frequency, whereas the section around position "B" defines a region of relatively low frequency. Although illustrated with relatively low frequency undulations for clarity, some embodiments may have undulations that are effectively "ridged" to produce a vibration in the chair unit, rather than (or in addition to) a slow up-and-down motion.

Different tracks may also be used to mimic different road conditions, and the rocking device is preferably constructed such that the profiled tracks are removable, and hence interchangeable, so that parents can select a track to mimic a range of motion that is particularly effective to soothing their child.

Figure 4:
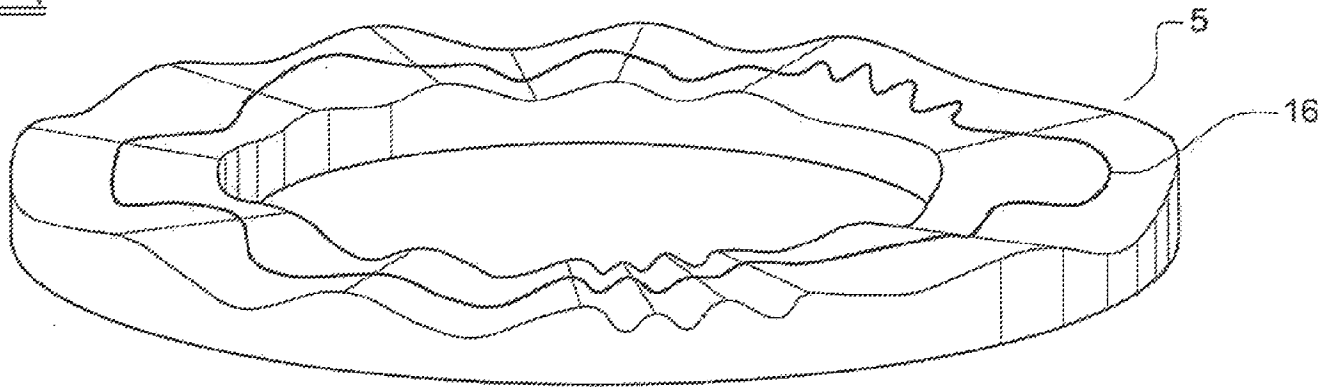
FIG. 4 is a perspective view of an alternative profiled track.

FIG. 4 illustrates an alternative embodiment of a profiled track 5. This again has an undulating profile (in the vertical direction, as illustrated), but in addition has a meandering groove 16. In this embodiment, the track follower may be readily adapted to engage with this groove 16, thus providing a side-to-side motion as well as an up-and-down motion. Thus, the track is overall shaped to create relative displacement between the seat and the base unit in more than one spatial dimension. Again, the path of the groove may be arranged to provide high and low frequency (and amplitude) displacement in the horizontal plane.

Figure 5:
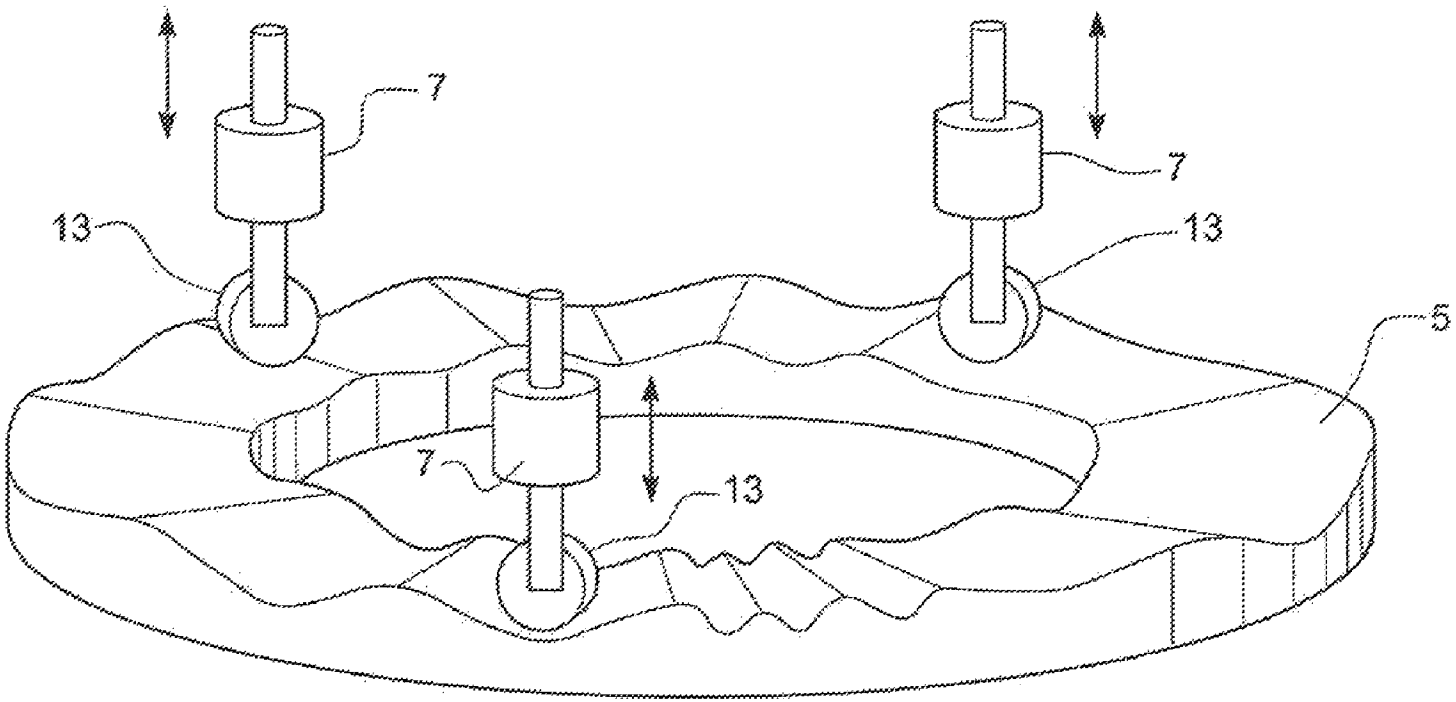
FIG. 5 is a perspective view of a profiled track with dampers.

FIG. 5 illustrates, again in perspective view, part of an embodiment of the invention having a profiled track 5, interacting with multiple track followers 13. In this way, a wider range of rocking motions can be mimicked. In this embodiment, each of the track followers 13 is connected to the seat unit (not illustrated) via a spring damper 7 to modulate the motion of the seat in response to the undulating track.

Particularly preferred additional features of the invention are as follows:

- The seat should be cushioned, to make it particularly suitable for children aged 6 weeks to 10 years
- The base unit of the device may be adapted to accommodate a variety of seat sizes and child weights, to allow the device to used over time as a child grows
- Any spring dampers used on the device may be removable interchangeable, or of variable strengths, to accommodate different weight children, or to adjust the device as a child grows
- The device may be equipped with a timer, to allow a parent to set a desired time interval for the device to rock a child, the device switching off thereafter.

The device may be powered by mains electricity, or preferably by internal batteries. where the device is adapted for use in a vehicle (see above), electrical power may be derived from the vehicle itself.

The track follower ideally travels around the profiled track once every one to five minutes, and preferably every 1.5 to 3.5 minutes. The inventors have found that this gives a sufficient variety of rocking motion before repeating itself to simulate vehicle motion to induce restfulness and sleep.

The undulations of the profiled track should be irregular in nature, again to provide an adequate simulation of the vehicle motion.

The absence of a pivoting or especially a hinged connection between the seat unit and the base allows motion of the seat unit to be reproduced in multiple dimensions, allowing the seat unit to roll and pitch; a certain degree of slackness may also be introduced into the connection between the seat unit and the base unit to allow a small degree of yaw, i.e. periodic rotational movement of the seat unit with respect to the base, without full rotation. It is envisaged that the seat unit might be allowed to turn by up to 10, 20 or 45 degrees in either direction before returning to its starting position.

The invention claimed is:

1. A rocking device comprising a seat unit and a base unit, operatively coupled by a motion generator, said motion generator comprising: a profiled track defining a closed undulating path; a track follower, arranged to interact with said profiled track; means to impart relative rotational movement between said profiled track and said track follower, thereby creating relative displacement between said seat unit and said base unit, and decoupling means to decouple the relative displacement between the seat and base from any rotational movement of the seat unit, wherein the undulations are irregular in nature, there being a section of track around a first position that defines a region of high frequency of undulation and a further section around a second position that defines a region of relatively low frequency of undulation.

2. A rocking device according to claim 1, wherein the undulations in the track define a path that varies both in its frequency of undulation and in its amplitude.

3. A rocking device according to claim 1, comprising undulations that are effectively ridged to produce a vibration in the seat unit, rather than an up-and-down motion.

4. The rocking device of claim 1 wherein the decoupling means comprises a rotatable mounting between at least one of said seat unit and base unit and at least one of said profiled track and track follower.

5. The rocking device of claim 1 further comprising a damper to modulate the relative displacement between the seat unit and the base unit.

6. The rocking device of claim 5 comprising a plurality of dampers.

7. The rocking device of claim 5 wherein the damper is operably connected between the seat unit and the base unit.

8. The rocking device of claim 5 wherein the damper is operably connected between the seat unit and the track follower.

9. The rocking device of claim 1 wherein the profiled track is so shaped as to create relative displacement between the seat unit and the base unit in more than one spatial dimension.

* * * * *